United States Patent [19]

Nedwick

[11] Patent Number: 5,037,095

[45] Date of Patent: Aug. 6, 1991

[54] QUARTERBACK TRAINER GAME APPARATUS

[76] Inventor: William J. Nedwick, 15 Prospect St., Glen Head, N.Y. 11545

[21] Appl. No.: 595,556

[22] Filed: Oct. 11, 1990

[51] Int. Cl.[5] ..... A63B 69/00

[52] U.S. Cl. ..... 273/55 R; 273/400

[58] Field of Search ..... 273/55 R, 410, 181 A, 273/328, 398, 400, 402, 410, 407, 181 C, 181 B

[56] References Cited

U.S. PATENT DOCUMENTS

| | | | |
|---|---|---|---|
| 469,554 | 2/1892 | Favor | 273/407 |
| 3,122,367 | 2/1964 | Dale | 273/407 |
| 3,810,616 | 5/1974 | Murphy | 273/26 A |
| 3,822,883 | 7/1974 | DeVos | 273/26 A |
| 3,929,334 | 12/1975 | Magazzu | 273/26 A |
| 4,497,485 | 2/1985 | Macosico | 273/407 |
| 4,625,974 | 12/1986 | Andrews | 273/407 |
| 4,629,188 | 12/1986 | Mahieu | 273/407 |
| 4,826,164 | 5/1989 | Butcher | 273/26 A |

*Primary Examiner*—Theatrice Brown

*Attorney, Agent, or Firm*—Richard L. Miller

[57] ABSTRACT

A quarterback trainer game apparatus is provided and consists of a flexible back panel suspended from a frame member which is suspended from a support structure. Large and small netting basket pockets are carried in the back panel while a back up net having a bottom ball retainer portion is secured to the frame member to hang loose. When a football is thrown by a person and misses the large and small netting basket pocket it will hit the back up net and fall into the bottom ball retainer portion.

5 Claims, 1 Drawing Sheet

QUARTERBACK TRAINER GAME APPARATUS

BACKGROUND OF THE INVENTION

The instant invention relates generally to football practicing equipment and more specifically it relates to a quarterback trainer game apparatus.

Numerous football practicing equipment have been provided in the prior art that are adapted to help football players enhance their playing skills. For example, U.S. Pat. No. 3,810,618 to Nedwick all are illustrative of such prior art. While these units may be suitable for the particular purpose to which they address, they would not be as suitable for the purpose of the present invention as hereafter described.

SUMMARY OF THE INVENTION

A primary object of the present invention is to provide a quarterback trainer game apparatus that will overcome the shortcomings of the prior art devices.

Another object is to provide a quarterback trainer game apparatus that will develop the skill in playing football by a person utilizing a target type of game structure.

An additional object is to provide a quarterback trainer game apparatus that can be used in a game of football that can be played in driveways and backyards by throwing a football into two different sized netting back pockets.

A further object is to provide a quarterback trainer game apparatus that is simple and easy to use.

A still further object is to provide a quarterback trainer game apparatus that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

DESCRIPTION OF THE DRAWING FIGURES

The figures in the drawings are briefly described as follows.

DESCRIPTION OF THE PREFERRED EMBODIMENTS

Figures 1, 2, 3, 4, 5:
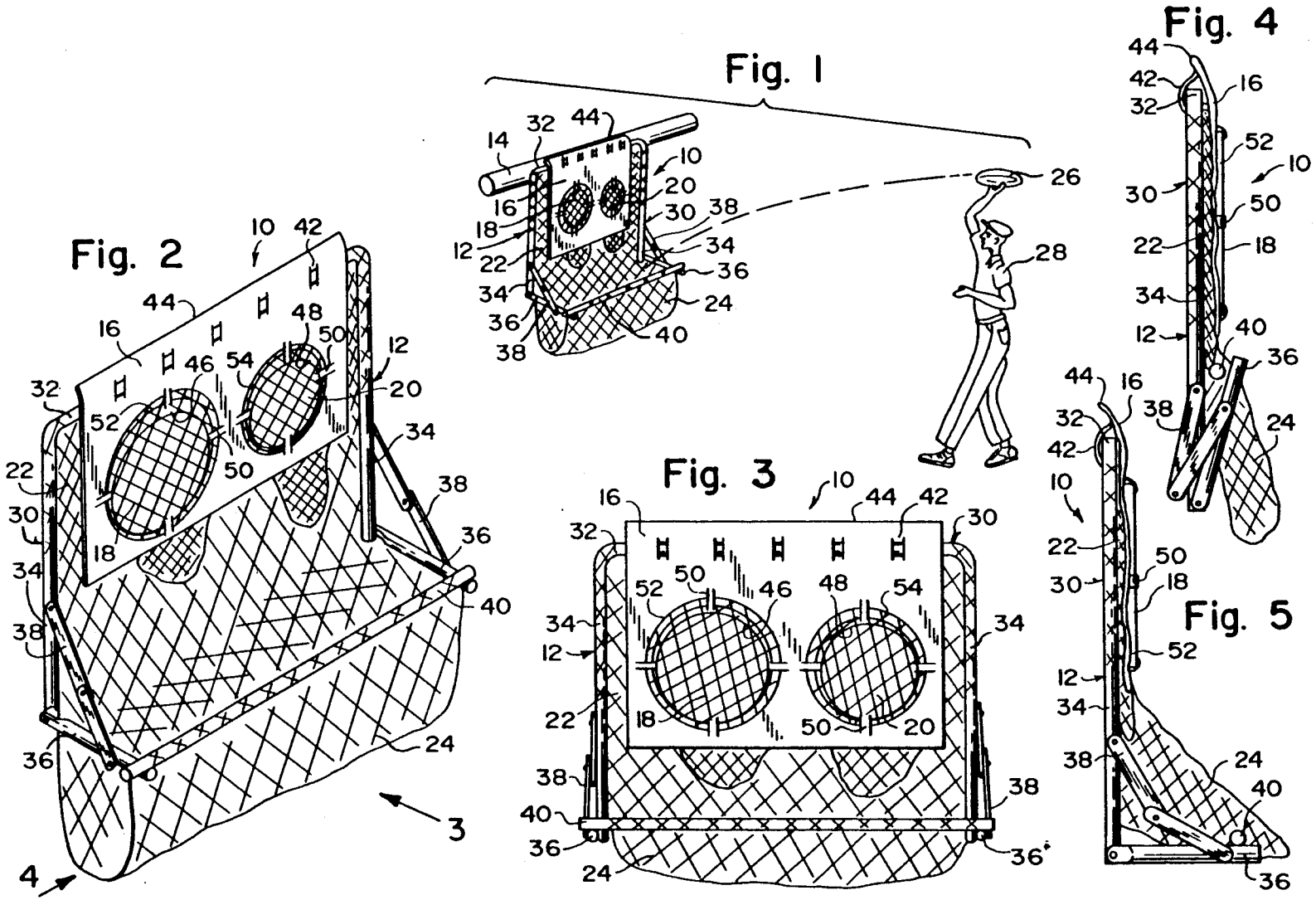
FIG. 1 is a perspective view illustrating the instant invention in use.
FIG. 2 is an enlarged perspective view thereof.
FIG. 3 is a front view taken in the direction of arrow 3 in FIG. 2 with parts broken away.
FIG. 4 is a side view taken in the direction of arrow 4 in FIG. 2 with the apparatus in a folded position.
FIG. 5 is a view similar to FIG. 4, but with the apparatus open and standing on the ground.

Turning now descriptively to the drawings, in which like reference characters denote like elements throughout the several views, the Figures illustrate a quarterback trainer game apparatus 10 consisting of a frame member 12 suspended from a support structure 14 while a flexible back panel 16 is suspended from the frame member 12. A large netting basket pocket 18 is carried in the back panel 16 and is used during the play of the game for the defense. A small netting basket pocket 20 is carried in the back panel 16 and is used during the play of the game for the offense. A back up net 22 having a bottom ball retainer portion 24 is also provided. The back up net 22 is secured to the frame member 12 to hang loose, so that when a football 26 is thrown by a person 28 and misses the large and small netting basket pockets 18 and 20 it will hit the back up net 22 and fall into the bottom ball retainer portion 24.

The frame member 12 includes an inverted U-shaped rod 30 having an upper segment 32 and two side segments 34. The upper segment 32 is suspended from the support structure 14. A side arm 36 is pivotally mounted at one end to a distal end of each side segment 34 of the rod 30. A foldable drop rail 38 is pivotally mounted at an angle between one side segment 34 of the rod 30 and one side arm 36 so that the drop rails 38 will keep the side arms 36 extending perpendicular from the side segments 34 of the rod 30 when the drop rails 38 are opened. A front cross bar 40 is mounted between the free ends of the side arms 36 so that the bottom ball retainer portion 24 of the back up net 22 is secured to the front cross bar 40.

The flexible back panel 16 is formed from a sheet of plastic material and has a series of loops 42 formed near the top edge 44 which engages with the upper segment 32 of the rod 30. The back panel 16 has a large aperture 46 and a small aperture 48 therethrough with a plurality of loops 50 formed about the large aperture 46 and the small aperture 48. The large netting basket pocket 18 has a large hoop 52 which fits through the loops 50 about the large hoop 52 which fits through the loops 50 about the large aperture 46 in the back panel 16. The small netting basket pocket 20 has a small hoop 54 which fits through the loops 50 about the small aperture 48 in the back panel 16. The rod 30 is fabricated out of a one piece steel tubing bent into the inverted U-shaped configuration. In order to better illustrate the operative use of the invention a typical set of rules are set forth in an appendix as follows.

APPENDIX

Rules for playing the quarterback trainer game. The quarterback trainer game is a game of football that can be played in driveways and backyards by actually throwing a football 26 into two different size pockets, one pocket 20 being the offense and the other pocket 18 the defense. All of the football plays are executed by dropping back to designated yard markers of 2, 3, 4, 5 and 6 years. The toss of a coin decides the kicking and receiving teams.

The Kick Off The kicker drops back to the six yard marker and throws into the offensive pocket 20. If it enters the pocket the receiving team gets the ball 26 on the goal line. If it hits the back up net 22 the ball comes out to the twenty yard line. If it enters the defensive pocket 18, it was run back for a touchdown.

The Run The running plays are all thrown from the four and five yards markers. The offensive team has four downs to move the ball ten yards. The quarterback drops back to the four yard marker and the ball 26 is thrown into the offensive pocket 20. If completed, it is second and five with the ball on the twenty-five yard line. If it hits the back up net 22, it is a loss of down. It enters the defensive pocket 18, it is loss of five yards an is then second and fifteen. To make up extra yardage the quarterback drops back to the five yard marker. Any-time the offensive team steps over a yard marker he is offside and receives a five yard penalty.

The Pass The bomb is thrown from the six yard marker. If it enters the offensive pocket 20 it is a touchdown. If it hits the back up net 22 it is an incomplete pass and a loss of down. If it enters the defensive pocket 18, it is a interception and the ball goes back to the line of scrimmage. The other team then takes over the ball 26. On passing plays from the six yard marker you step over the line it is loss of down.

The Extra Point To score an extra point the drop back is to the three yard marker. If the ball 26 enters the offensive pocket 20 it is one point. If it enters the defensive pocket 18 it is a blocked kick. If it hits the back up net 22 the play is over and the scoring team kicks off to the opponent.

The Field Goal Field goals kicked from between the five and thirty yard lines are thrown from the three yard marker. If it enters the offensive pocket 20 it is three points. If it enters the defensive pocket 18 it is a blocked kick; the ball 26 goes back to the line of scrimmage and the other team takes over the ball. If it hits the back up net 22, the ball comes out to the twenty yard line. Field goals kicked from between t he thirty-five and fifty yard line are thrown from the five yard marker. The same rules apply here as mentioned above.

The Punt The longest kick that can be made is fifty yards and it is thrown from the six yard marker. If it enters the offensive pocket 20 it is a fifty yard kick. If it enters the defensive pocket 18 it is a blocked kick and the bal goes back to the line of scrimmage and the other team puts the ball 26 in play. If it hits the back up net 22, it is a thirty yard kick.

Offside Any time the offensive team steps over a yard marker while throwing he is offside. Penalty: five yards. To make up extra yardage, the quarterback drops back to the five yard marker. It becomes second and fifteen. If the ball 26 misses the back up net 22 it is a fumble, the opponent recovers the ball and puts it in play at the original line of scrimmage.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A quarterback trainer game apparatus comprising:

(a) a frame member suspended from an upper support structure;

(b) a flexible back panel suspended from the frame member and having front and rear surfaces;

(c) a large aperture having a netting basket pocket carried in said back panel, (d) a small aperture having a netting basket pocket carried in said back panel, and (e) a back up net having a bottom ball retainer portion, said back up net secured to said frame member to hang loose beneath and in front of said back panel, so that when a football is thrown by a person and misses said large and small netting basket pockets it will hit said back up net and fall into the bottom ball retainer portion and in front of said back panel.

2. A quarterback trainer game apparatus as recited in claim 1, wherein said frame member includes:

(a) a rod formed into inverted U-shaped member having an upper horizontal segment and two spaced apart, vertically extending segments side segments, the upper segment being attached to said support structure and said side segments extending downwardly from said upper segment, (b) a pair of side arms, each being pivotally mounted at one end thereof to the lower end of one side segment, (c) a pair of foldable drop rails, each pivotally mounted at an angle between one side segment and one said side arm so that said drop rails will keep said side arms extended perpendicular from the side segments when said drop rails are opened to extend in front of said back panel; and (d) a front cross bar attached to and between the other end of said side arms, said bottom ball retainer portion of said back up net is secured to said front cross bar.

3. A quarterback trainer game apparatus as recited in claim 1, wherein said flexible back panel is a sheet of plastic material and having a series of loops formed near the top end of which engages said upper horizontal segment of said rod.

4. A quarterback trainer game apparatus as recited in claim 3, further including:

(a) said back panel with a plurality of loops formed about the large aperture and said small aperture;

(b) said large netting basket pocket having a large hoop which fits through the loops about the large aperture in said back panel; and (c) said small netting basket pocket having a small hoop which fits through the loops about the small aperture in said back panel.

5. A quarterback trainer game apparatus as recited in claim 4, wherein said rod is fabricated from a one piece steel tubing.

* * * * *